US009199244B2

(12) United States Patent
Belotserkovskiy

(10) Patent No.: US 9,199,244 B2
(45) Date of Patent: Dec. 1, 2015

(54) METHOD FOR EMPTYING AN INERTIA CONE CRUSHER

(75) Inventor: Konstantin Belotserkovskiy, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 20 days.

(21) Appl. No.: 14/125,591

(22) PCT Filed: May 29, 2012

(86) PCT No.: PCT/EP2012/059971

§ 371 (c)(1),
(2), (4) Date: Dec. 12, 2013

(87) PCT Pub. No.: WO2012/171774

PCT Pub. Date: Dec. 20, 2012

(65) Prior Publication Data

US 2014/0103150 A1 Apr. 17, 2014

(30) Foreign Application Priority Data

Jun. 13, 2011 (EP) ..... 11169686

(51) Int. Cl.
*B02C 25/00* (2006.01)
*B02C 2/04* (2006.01)

(52) U.S. Cl.
CPC . *B02C 25/00* (2013.01); *B02C 2/04* (2013.01); *B02C 2/042* (2013.01)

(58) Field of Classification Search
CPC ..... B02C 2/00; B02C 2/04; B02C 2/042; B02C 25/00
USPC ..... 241/207–216, 101.3, 35–37
See application file for complete search history.

(56) References Cited

U.S. PATENT DOCUMENTS 4,589,600 A * 5/1986 Schuman ..... 241/215

FOREIGN PATENT DOCUMENTS

| | | | |
|---|---|---|---|
| CN | 1262151 | A | 8/2000 |
| CN | 101500710 | A | 8/2009 |
| CN | 101626836 | A | 1/2010 |
| EP | 0093069 | A2 | 11/1983 |
| EP | 2116307 | A1 | 11/2009 |

* cited by examiner

*Primary Examiner* — Faye Francis
(74) *Attorney, Agent, or Firm* — Corinne R. Gorski

(57) ABSTRACT

A method for at least partly emptying a crushing chamber formed between an inner crushing shell and an outer crushing shell of an inertia cone crusher is provided. The inner crushing shell is supported on a crushing head. A central axis of the crushing head gyrates about a gyration axis with an rpm, for crushing material in the crushing chamber. The method includes the steps of interrupting the feeding of material to the crusher; measuring, directly or indirectly, at least one of a position and a motion of the crushing head during an amplitude control period; comparing the measured position and/or motion with at least one set point value; determining, based on the comparison, the measured position and/or motion to at least one set point value, whether the rpm should be adjusted; and adjusting the rpm when necessary.

9 Claims, 5 Drawing Sheets

METHOD FOR EMPTYING AN INERTIA CONE CRUSHER

RELATED APPLICATION DATA

This application is a §371 National Stage Application of PCT International Application No. PCT/EP2012/059971 filed May 29, 1991, claiming priority of EP Application No. 11169686.0, filed Jun. 13, 2011.

TECHNICAL FIELD OF THE INVENTION

The present invention relates to a method for at least partly emptying a crushing chamber formed between an inner crushing shell and an outer crushing shell of an inertia cone crusher. The present invention further relates to an inertia cone crusher performing the method.

BACKGROUND OF THE INVENTION

An inertia cone crusher may be utilized for efficient crushing of material, such as stone, ore etc., into smaller sizes. An example of an inertia cone crusher can be found in EP 2116307. In such an inertia cone crusher material is crushed between an outer crushing shell, which is mounted in a frame, and an inner crushing shell, which is mounted on a crushing head. The crushing head is mounted on a crushing head shaft. An unbalance weight is arranged on a cylindrical sleeve-shaped unbalance bushing encircling the crushing head shaft. The cylindrical sleeve is, via a drive shaft, connected to a pulley. A motor is operative for rotating the pulley, and, hence, the cylindrical sleeve. Such rotation causes the unbalance weight to rotate and to swing to the side, causing the crushing shaft, the crushing head, and the inner crushing shell to gyrate and to crush material that is fed to a crushing chamber formed between the inner and outer crushing shells.

In order for an inertia cone crusher to be able to function correctly, the crusher should operate under load, i.e. the crushing chamber should be continually fed with material to be crushed. Material is fed into the crushing chamber via a feeding hopper and the level of the material in the feeding hopper is controlled to minimize the risk that the feeding hopper is emptied while the crusher is still operating. If an inertia cone crusher operates without material, or with too little material, inside the crushing chamber the crushing shells may be damaged by the crushing head. Thus, when an inertia cone crusher is stopped, the crushing chamber is usually full of material, to avoid that the crushing shells are demolished by the crushing head.

SUMMARY OF THE INVENTION

An object of the present invention is to provide a method for safely emptying a crushing chamber of an inertia cone crusher, for instance at maintenance work stops and at stops for removing tramp material, and to minimize the risk that the inertia cone crusher will be damaged at such stops.

This object is achieved by means of a method for at least partly emptying a crushing chamber formed between an inner crushing shell and an outer crushing shell of an inertia cone crusher. The inner crushing shell is supported on a crushing head which is rotatably connected to an unbalance bushing which is rotated by a drive shaft. The unbalance bushing is provided with an unbalance weight for tilting the unbalance bushing such that the central axis of the crushing head will gyrate about a gyration axis with an rpm (revolutions per minute). The method comprises interrupting feeding of material to the crusher; measuring, directly or indirectly, at least one of a position and a motion of the crushing head during an amplitude control period; comparing the measured position and/or motion to at least one set point value; determining, based on said comparing the measured position and/or motion to at least one set point value, whether said rpm should be adjusted; and adjusting, when determined necessary, said rpm.

The rpm is adjusted to suit the particular amount of material inside the crusher. Thus, the risk of having too little material inside the crusher while still running the crusher on an rpm which may harm the crusher parts, such as the inner crushing shell and the outer crushing shell, is lowered.

Optionally, adjusting the rpm is made by decreasing the rpm. The rpm may be decreased, step-by-step, in view of the amount of material present inside the crusher, such that the rpm is not too high in view of the material that is still present in the crushing chamber.

Optionally, the method comprising obtaining, based on the position and/or motion of the crushing head, an amplitude of said crushing head. The amplitude may be used for determining the amount of material which is present in the crushing chamber. Ideally the amplitude may be constant during crushing as well as during emptying of the crusher. An increasing amplitude may imply that less material is present in the crushing chamber, meaning that it is time to reduce the rpm, to avoid that the inner crushing shell causes damage to the outer crushing shell. A decreasing amplitude may imply that the crushing is not efficient, and that the rpm could, at least temporarily, be increased.

Optionally, the method comprises measuring a level of material in a feeding device during a level control period prior to the amplitude control period. The feeding device is operative for forwarding material to be crushed to the crushing chamber. The level control period may be used prior to the amplitude control period to get efficient crushing during a period of time before the amplitude control period begins. Utilizing the level control period may give a faster emptying process, since crushing can be made at a relatively high rpm, as long as the level is still high enough to fill the crushing chamber.

Optionally, the method comprises controlling the rpm based on the measured level of material in the feeding device during the level control period. It may be preferred to control the rpm, which in practical operation would often mean to gradually decrease the rpm, during the level control period to minimize the risk of running the crusher with too high crushing rpm, in view of the amount of material which is present in the crushing chamber, to avoid damage to the crusher.

Optionally, the method comprises determining, during the level control period and based on the measured level of material in the feeding device, whether the amplitude control period should start; or if the level control period should continue. An advantage of this embodiment is that the level control period can be controlled to last as long as it is regarded safe, with regard to the accuracy of the level measurement and the expected amount of material in the crushing chamber, and that the amplitude control period can be controlled to start when level control is no longer regarded reliable enough to avoid damage to the crusher.

Optionally, the method comprises, during a low frequency period, decreasing the rpm to a non crushing rpm where no significant crushing occurs in the crushing chamber; increasing the rpm to a lowest crushing rpm where significant crushing in the crushing chamber again occurs; and crushing material in the crushing chamber. By decreasing the rpm to a non crushing rpm and thereafter increasing the rpm to a lowest crushing rpm it is assured that the lowest possible rpm is used when emptying the crusher. By crushing at the lowest possible rpm, the risks of causing damage to the crusher are substantially reduced, since damage is correlated to rpm. The low frequency period may be followed by the amplitude control period to further minimize the risk of damaging the crusher during the entire emptying process.

Optionally, the method comprises determining, during the level control period and based on the level of material in the feeding device, whether the amplitude control period should start; or if the low frequency period should start; or if the level control period should continue. A further object of the present invention is to provide an inertia cone crusher in which a crushing chamber may be emptied prior to or during stoppage of the crusher.

This object is achieved by means of an inertia cone crusher comprising an outer crushing shell and an inner crushing shell. The inner and outer shells forming between them a crushing chamber and the inner crushing shell being supported on a crushing head. The crushing head is rotatably connected to an unbalance bushing which is arranged to be rotated by a drive shaft. The unbalance bushing is provided with an unbalance weight for tilting the unbalance bushing when it is rotated such that the central axis of the crushing head will, when the unbalance bushing is rotated by the drive shaft and tilted by the unbalance weight, gyrate about a gyration axis. The inner crushing shell thereby approaches the outer crushing shell for crushing material in the crushing chamber. The crusher further comprises a sensor for sensing at least one of a position and a motion of the crushing head. The crusher further comprises a controller configured to perform the method for at least partly emptying the crushing chamber which method is described above.

BRIEF DESCRIPTION OF THE DRAWINGS

The invention is described in more detail below with reference to the appended drawings in which.

DESCRIPTION OF PREFERRED EMBODIMENTS

Figure 1:
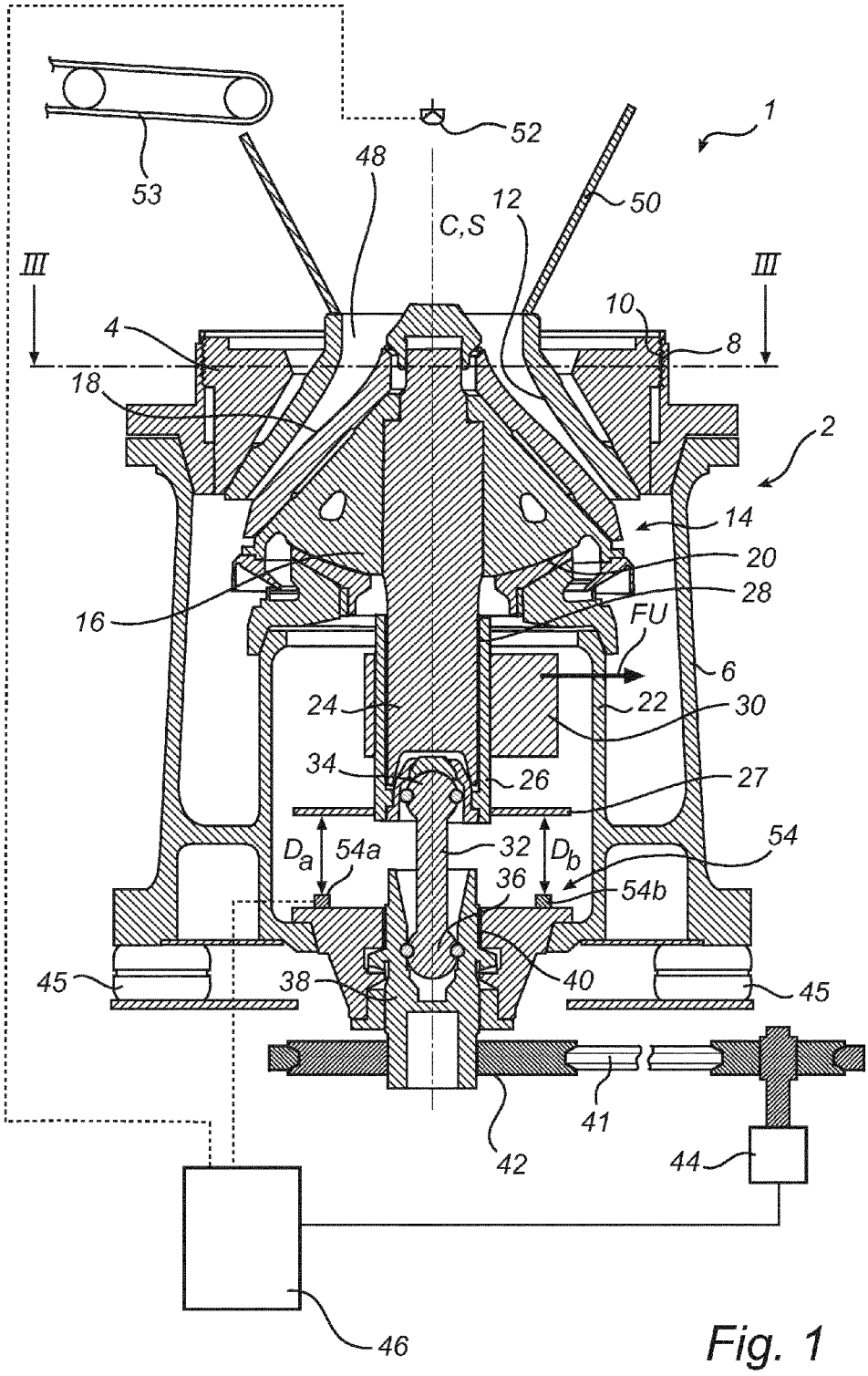
FIG. 1 is a schematic side view, in cross-section, of an inertia cone crusher.

FIG. 1 illustrates an inertia cone crusher 1 in accordance with one embodiment of the present invention. The inertia cone crusher 1 comprises a crusher frame 2 in which the various parts of the crusher 1 are mounted. The crusher frame 2 comprises an upper frame portion 4, and a lower frame portion 6. The upper frame portion 4 has the shape of a bowl and is provided with an outer thread 8, which co-operates with an inner thread 10 of the lower frame portion 6. The upper frame portion 4 supports, on the inside thereof, an outer crushing shell 12. The outer crushing shell 12 is a wear part which may be made from, for example, manganese steel.

The lower frame portion 6 supports an inner crushing shell arrangement 14. The inner crushing shell arrangement 14 comprises a crushing head 16, which has the shape of a cone and which supports an inner crushing shell 18, which is a wear part that can be made from, for example, a manganese steel. The crushing head 16 rests on a spherical bearing 20, which is supported on an inner cylindrical portion 22 of the lower frame portion 6.

The crushing head 16 is mounted on a crushing head shaft 24. At a lower end thereof, the crushing head shaft 24 is encircled by an unbalance bushing 26, which has the shape of a cylindrical sleeve. The unbalance bushing 26 is provided with an inner cylindrical bearing 28 making it possible for the unbalance bushing 26 to rotate relative to the crushing head shaft 24 about a central axis S of the crushing head 16 and the crushing head shaft 24. A gyration sensor reflection disc 27, which will be described in more detail below, stretches radially out from, and encircles, the unbalance bushing 26.

An unbalance weight 30 is mounted on one side of the unbalance bushing 26. At its lower end the unbalance bushing 26 is connected to the upper end of a vertical transmission shaft 32 via a Rzeppa joint 34. Another Rzeppa joint 36 connects the lower end of the vertical transmission shaft 32 to a drive shaft 38, which is journalled in a drive shaft bearing 40. Rotational movement of the drive shaft 38 can thus be transferred from the drive shaft 38 to the unbalance bushing 26 via the vertical transmission shaft 32, while allowing the unbalance bushing 26 and the vertical transmission shaft 32 to be displaced from a vertical reference axis C during operation of the crusher 1.

A pulley 42 is mounted on the drive shaft 38, below the drive shaft bearing 40. An electric motor 44 is connected via a belt 41 to the pulley 42. According to one alternative embodiment the motor may be connected directly to the drive shaft 38.

The crusher 1 is suspended on cushions 45 to dampen vibrations occurring during the crushing action.

The outer and inner crushing shells 12, 18 form between them a crushing chamber 48, to which material that is to be crushed is supplied from a feeding hopper 50 located above the crushing chamber 48. A sensor 52 for sensing a level of material in the feeding hopper 50 is located vertically above the feeding hopper 50. The discharge opening 51 of the crushing chamber 48, and thereby the crushing capacity, can be adjusted by means of turning the upper frame portion 4, by means of the threads 8, 10, such that the distance between the shells 12, 18 is adjusted. Material to be crushed may be transported to the feeding hopper 50 by a belt conveyor 53. However, for the purpose of clarity, no material to be crushed is shown in the crusher 1 in FIG. 1.

When the crusher 1 is in operation the drive shaft 38 is rotated by means of the motor 44. The rotation of the drive shaft 38 causes the unbalance bushing 26 to rotate and as an effect of that rotation the unbalance bushing 26 swings outwards, in the direction FU of the unbalance weight 30, displacing the unbalance weight 30 further away from the vertical axis C, in response to the centrifugal force to which the unbalance weight 30 is exposed. Such displacement of the unbalance weight 30, and of the unbalance bushing 26 to which the unbalance weight 30 is attached, is allowed thanks to the flexibility of the Rzeppa joints 34, 36 of the vertical transmission shaft 32, and thanks to the fact that the crushing head shaft 24 may slide somewhat in the axial direction in the cylindrical bearing 28 of the sleeve shaped unbalance bushing 26. The combined rotation and swinging of the unbalance bushing 26 causes an inclination of the crushing head shaft 24, and allows the central axis S of the crushing head 16 and the crushing head shaft 24 to gyrate about a gyration axis, which during normal operation coincides with the vertical axis C, such that material is crushed in the crushing chamber 48 between the outer and inner crushing shells 12, 18. In FIG. 1 the crusher 1 is shown inoperative, i.e. in a non-gyrating state. Hence, the central axis S of the crushing head 16 and the crushing head shaft 24 coincides with the vertical axis C.

A control system 46 is configured to control the operation of the crusher 1. The control system 46 is connected to the motor 44, for controlling the power and/or the revolutions per minute (rpm) of the motor 44. The control system 46 is connected to and receives readings from a gyration sensor 54, which senses the location and/or motion of the gyration sensor reflection disc 27. By way of example, the gyration sensor 54 may comprise three separate sensing elements, which are distributedly mounted in a horizontal plane beneath the gyration sensor reflection disc 27, for sensing three vertical distances to the gyration sensor reflection disc 27 in the manner described in detail in EP2116307. Thereby, a complete determination of the tilt of the gyration sensor reflection disc 27, and hence also of the direction of the crushing head central axis S, may be obtained. In the section of FIG. 1, two sensing elements 54*a*, 54*b* of the sensor 54, for measuring two respective distances $D_a$, $D_b$, are illustrated; the third sensor is not visible in the section. In fact, the two distances $D_a$, $D_b$, obtained by the two sensors 54*a*, 54*b*, may, if the location of a third element of the crushing head 16 or the crushing head shaft 24 is known, suffice for obtaining the (direction) angle of the crushing head central axis S. The vertex 33 of the gyrating motion, which will be described below with reference to FIG. 3, may be used as such a fixed point.

According to the above, the sensor 54 is configured to obtain the angle of the central axis S. Alternatively, the sensor 54 may comprise only one single sensing element 54*a* for sensing the distance $D_a$ to one single point on the gyration sensor reflection disc 27. Thereby, an amplitude of the vertical movement of that particular portion on the gyration sensor reflection disc 27 may be obtained. Since the gyration sensor reflection disc 27 is arranged on the crushing head 16 it will gyrate along with the crushing head and the gyrating amplitude of the gyration sensor reflection disc 27 may be used as the amplitude for the gyrating movement of the crushing head 16. This is one of several possible amplitude definitions of the gyrating movement of the crushing head 16. Alternatively, the amplitude may be calculated as the time average, over an entire revolution of the crushing head 16 of the tilt angle $\alpha$ of the crushing head central axis S relative to the gyration axis C, or, as will be described in connection to FIG. 3 below, the tilt angle $\alpha$ may be used directly as the amplitude. For non-contact sensing of the distances $D_a$, $D_b$ to the gyration sensor reflection disc 27, the gyration sensor 54 may, for example, comprise a radar, an ultrasonic transceiver, and/or an optical transceiver, such as a laser instrument. The gyration sensor 54 may also operate by mechanical contact with the gyration sensor reflection disc 27.

In alternative embodiments, the gyration sensor 54 may be configured to sense the absolute or relative location of other parts of the unbalance bushing 26, the crushing head 16, or any components attached thereto.

Figure 2:
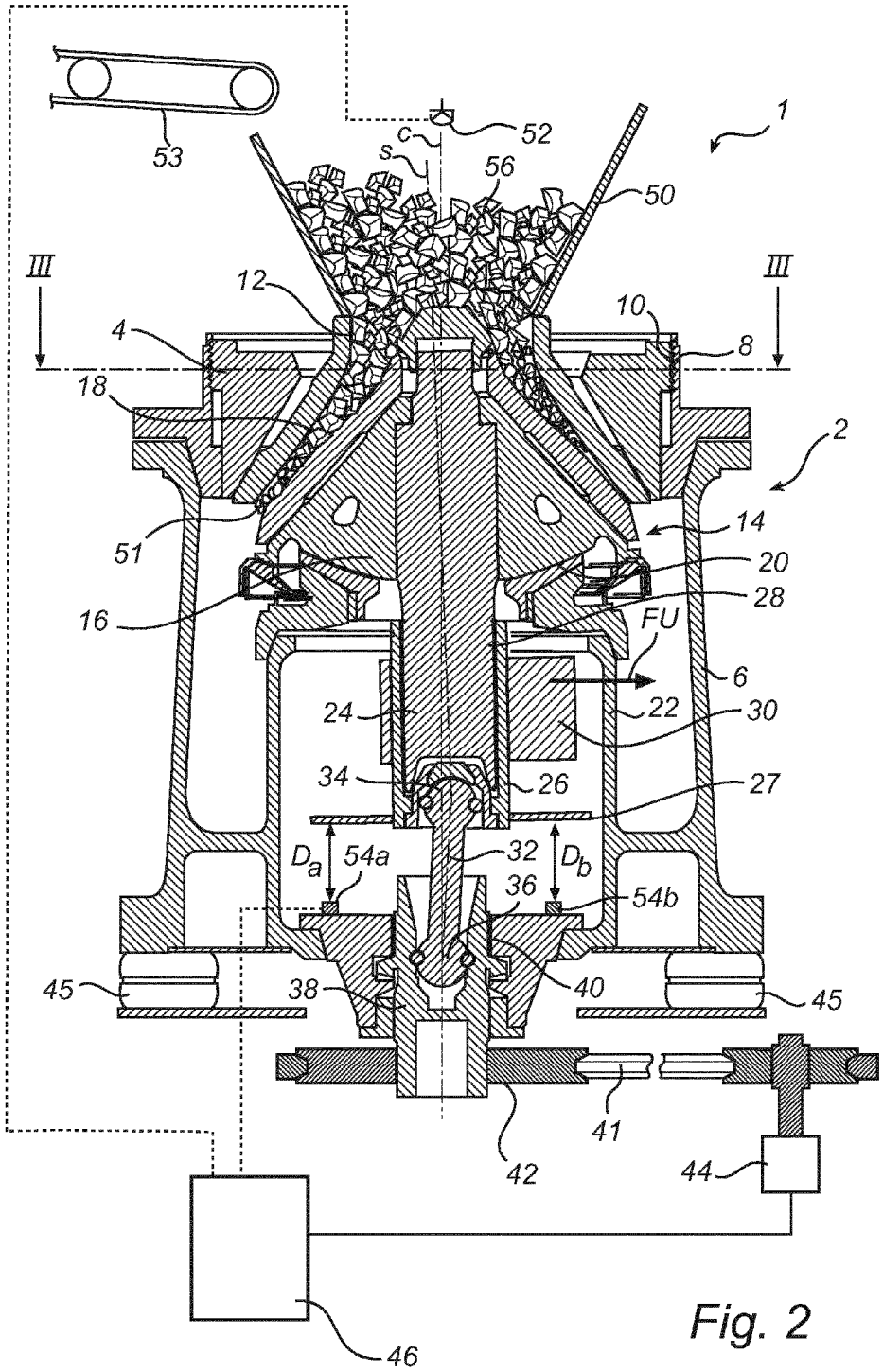
FIG. 2 is a schematic side view, in cross-section, of the inertia cone crusher in FIG. 1 during emptying of the crusher.

FIG. 2 shows the crusher 1 of FIG. 1 during emptying of the crusher 1. As will be described in more detail in connection to FIG. 3, the crushing head 16 illustrated in FIG. 2 gyrates about the vertical axis C. Thus, the crushing head 16 in FIG. 2 is not resting centrally in the crusher 1, as in FIG. 1, but the central axis S of the crushing head 16 is displaced from the vertical axis C. As the drive shaft 38 rotates the vertical transmission shaft 32 and the unbalance bushing 26, the unbalance weight 30 makes the unbalance bushing 26 swing out radially, thereby tilting the central axis S of the crushing head 16 and the crushing head shaft 24 relative to the vertical axis C.

Emptying of the crusher is carried out in several steps. In accordance with one embodiment the level of material in the feeding hopper 50 is controlled during a so called "level control period L" of the emptying process. As is illustrated in FIG. 2 the belt conveyor 53 has been turned off and no material is transported by the belt conveyor 53 to the feeding hopper 50. However, material 56 to be crushed is still present in the feeding hopper 50. The sensor 52 may be active for determining the level of material 56 in the feeding hopper 50. When the level of material 56 in the hopper 50 gets below a predetermined level, the level control period L is terminated and a so called "amplitude control period A" starts. Optionally the amplitude control period A is preceded by a so called "low frequency period LF" where the rpm is first decreased to a non crushing rpm, where no significant crushing occurs in the crushing chamber 48, and then increased to an rpm where significant crushing again occurs. The emptying process and the periods L, A, LF will be described in more detail in connection to FIGS. 4-5 below.

In FIG. 2, the level of material 56 in the feeding hopper 50 may be at a level where the amplitude control period A, or the low frequency period LF, of the emptying process has begun. Alternatively, the level of material 56 in the feeding hopper 50 shown in FIG. 2 is still high enough such that the level control period L is active.

Figure 3:
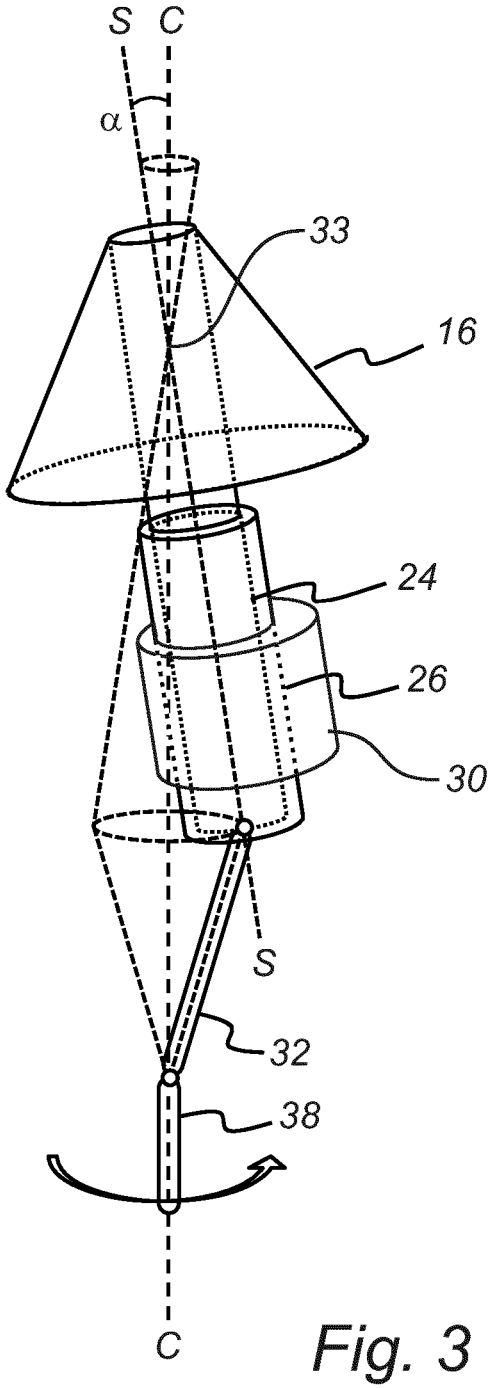
FIG. 3 is a schematic side view of the crushing head and the crushing head transmission parts of the inertia cone crusher of FIGS. 1-2.

FIG. 3 illustrates, schematically, the gyrating motion of the central axis S of the crushing head shaft 24 and the crushing head 16 about the vertical axis C during operation of the crusher 1. For reasons of clarity, only the rotating parts are schematically illustrated. In the same manner as described with reference to FIG. 2, the drive shaft 38 rotates the transmission shaft 32 and the unbalance bushing 26, and the unbalance weight 30 makes the unbalance bushing 26 swings out radially. Thus, the central axis S of the crushing head 16 and the crushing head shaft 24 is tilted relative to the vertical axis C. As the tilted central axis S is rotated by the drive shaft 38, it will follow a gyrating motion about the vertical axis C, the central axis S thereby acting as a generatrix generating two cones meeting at an apex 33. An angle $\alpha$, formed at the apex 33 by the central axis S of the crushing head 16 and the vertical axis C, will vary depending on the mass of the unbalance weight 30 (FIG. 1), the rpm at which the unbalance weight 30 is rotated, and the type and amount of material that is to be crushed. Hence, the faster the drive shaft 38 rotates, the more the unbalance bushing 26 will tilt the central axis S of the crushing head 16 and the crushing head shaft 24. Since the material in the crushing chamber 48 constrains the motion of the crushing head 16, the extent to which the central axis S may tilt from the vertical axis C is dependent on the type and amount of material present in the crushing chamber 48 illustrated in FIGS. 1 and 2. The tilt a of the central axis S during use of the crusher 1 may also be referred to as the amplitude $\alpha$ of the gyrating crushing head 16.

During normal operating conditions of the crusher 1, the unbalance bushing 26 would typically be rotated at a rather constant rpm and material is continuously fed into the crushing chamber 48, why the tilt a of the central axis S of the crushing head 16 with respect to the vertical axis C of the crusher 1 is essentially constant. Hence, during normal crusher operation material is continuously transported by the conveyor 53 to the feeding hopper 50 and further to the crushing chamber 48 in proportion to the amount of material which is crushed and discharged from the crushing chamber 48 through the discharge opening 51 thereof.

However, if less material is fed into the crushing chamber 48 than what is discharged from the crushing chamber 48, or if no material at all is fed into the crushing chamber 48, the tilt a of the central axis S, with respect to the vertical axis C, increases, if the rpm is kept constant. An increasing amplitude α will lead to increasing impact from the crushing head 16 on the crushing surfaces 12, 18. Thus, the inner crushing shell 18 on the crushing head 16 may approach and even contact the outer crushing shell 12. A contact between the outer and inner crushing shells 12, 18 may cause damage to the crushing shells 12, 18, the upper frame portion 4, the crushing head 16, and to other parts of the crusher. When the crushing chamber 48 is empty or nearly empty there is, hence, a risk that the crusher 1 will be demolished.

By way of example, during normal crushing operation, the unbalance weight rotation may be 600 rpm and the amplitude α may be 1.0 degree. A frequency below which no substantial crushing occurs, i.e. a non crushing unbalance weight rotation or non crushing rpm may be at 200 rpm, if the crushing chamber 48 is full of material to be crushed. If the crusher 1 is run with less material in the crushing chamber 48 the non crushing rpm may be even lower than 200 rpm. The non crushing rpm should preferably be above the resonant unbalance rotation of the crusher 1, which may be at 50 rpm.

Figure 4A:
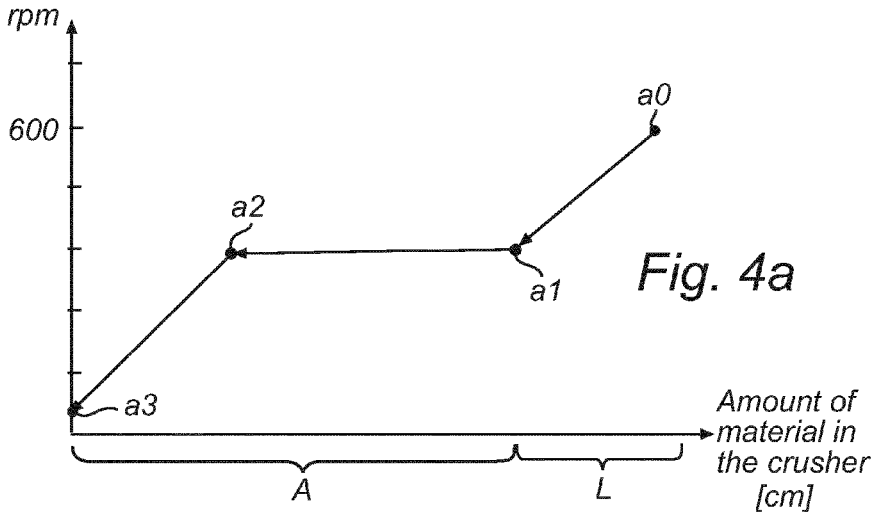
FIGS. 4*a-c* are graphs illustrating three methods of emptying the inertia cone crusher illustrated in FIGS. 1-3.

FIG. 4*a* is a graph illustrating a first embodiment of a method of emptying the crusher 1 of FIGS. 1-3 by controlling the rpm. The crusher 1 is emptied by reducing the amount of material in the crusher 1, i.e. the amount of material present inside the feeding hopper 50 and inside the crushing chamber 48. Typically, the hopper 50 and the crushing chamber 48 would be almost completely emptied by this method, but some material residues may remain.

When the emptying of the crusher 1 is about to begin, the transport of material to the feeding hopper 50 is stopped, which is indicated by point a0 in the graph of FIG. 4*a*. The period between point a0 and point a1 in FIG. 4*a* is referred to as the level control period L, since the emptying process is controlled by the level of material in the hopper 50 as measured by means of the sensor 52 during this period. The sensor 52 may be that same sensor which is used during normal crushing for the purpose of securing that the feeding hopper 50 is continuously filled with new material to be crushed. However, during the emptying of the crusher the sensor 52 is used for measuring the actual level of material in the hopper 50, rather than for securing a full hopper.

The level of material in the feeding hopper 50 is gradually reduced, between point a0 and point a1 in FIG. 4*a*. During the level control period L the rpm is controlled, by means of the control system 46 illustrated in FIG. 1, based on the level in the hopper 50 as measured by means of the sensor 52. Hence, the control system 46 reduces the rpm of the motor 44 gradually in view of the decreasing level in the feed hopper 50 to minimize the risk of an increased amplitude α during the level control period L. Eventually, the sensor 52 indicates that the level of material in the feeding hopper 50 is too low, meaning that the level of material in the crusher 1 is below a level at which the sensor 52 can give a reliable indication about the amount of material in the crushing chamber 48. At this point, indicated as point a1 in FIG. 4*a*, the amplitude control period A starts.

During the amplitude control period A the rpm is controlled, by means of the control system 46 illustrated in FIG. 1, based on the amplitude α of the crushing head 16 as measured by means of the sensor 54. Hence, the control system 46 reduces the rpm of the motor 44 gradually to avoid an increased amplitude α during the amplitude control period A. When the amplitude control period A starts, the rpm may be held constant for some time, as long as the amplitude α does not increase. The control system 46 will register the amplitude α of the crushing head 16, as described above in connection to FIG. 3. Thus, the amplitude α is used as an indicator on whether the rpm is at an appropriate level, or too high, in relation to the amount of material 56 which is present in the crushing chamber 48. As long as the amplitude α is essentially constant the amount of material 56 in the crushing chamber 48 is in balance with the rpm f, i.e. the rpm of the crusher 1 is at a level which is enough to have acceptable crushing but not too high with respect to the amount of material 56 in the crusher 1. Crushing continues at constant rpm, for example 300 rpm, until an increase in amplitude α is registered, indicated at point a2 in FIG. 4*a*.

Starting at point a2, the control system 46 gradually reduces the rpm of the motor 44 to reduce the rpm with the aim of avoiding that the amplitude α increases. In other words, if the amplitude α of the crushing head 16 increases the material level in the crushing chamber 48 is not in balance with the rpm f. The rpm is continually lowered between the points a2 and a3 in FIG. 4*a* to avoid that the amplitude α increases. During this period the control system 46 supervises the amplitude α and if an increase in amplitude α is registered the rpm may be further decreased until the amplitude α becomes constant. The process of gradually, step-by-step, lowering the rpm, i.e. the rpm of the motor 44, may continue until the crusher 1 is emptied or nearly emptied, which occurs at point a3.

It is also possible, as an alternative, to start decreasing the rpm already when the amplitude control period A starts at point a1. In that case the points a1 and a2 in FIG. 4*a* will coincide and the inclination of the graph between a2 and a3 will be less steep.

Figure 4B:
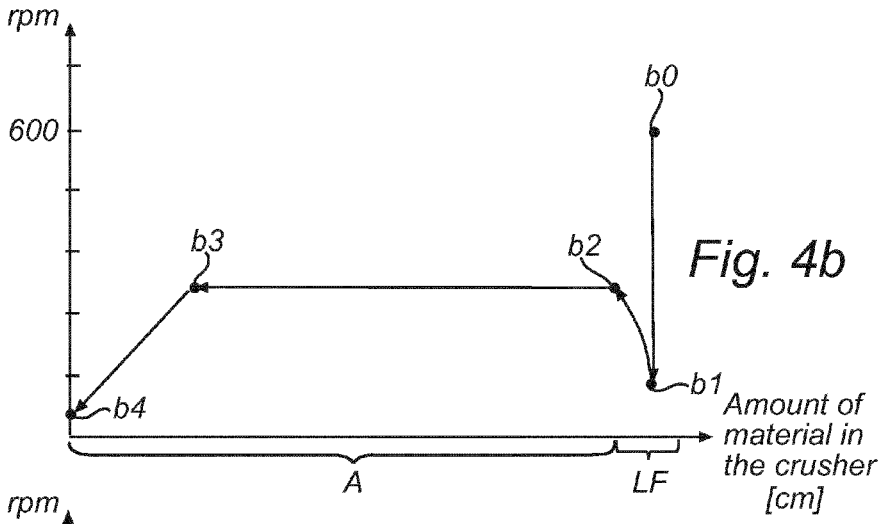

FIG. 4*b* is a graph illustrating a second embodiment of a method of emptying the crusher 1 of FIGS. 1-3 by controlling the rpm. In accordance with this embodiment, the emptying of the crusher 1 may be carried out by first abruptly stopping the crusher 1, or abruptly decreasing the rpm of the crusher 1 below the non crushing rpm. The feeding hopper 50 may still contain material 56 at this point. The stoppage of the crusher 1 is indicated by point b0 in FIG. 4*b*. Thereafter, at point b1, the crusher 1 is started and the rpm is increased until substantial crushing again occur, indicated by point b2 in FIG. 4*b*. Typically, the rpm at which crushing occurs is 200 rpm. The period starting at point b0 and ending at point b2 is referred to as the low frequency period LF. At point b2 an amplitude control period A starts, such amplitude control period A being similar to the amplitude control period described hereinbefore with reference to FIG. 4*a*. The crusher 1 is, hence, run, at the start of the amplitude control period A, at a constant rpm until an increase in amplitude α is registered, as described above in connection to FIG. 4*a*, indicated by point b3 in FIG. 4*b*. At point b3 the process of step-by-step lowering the rpm during supervision of the amplitude α is carried out, in the same manner as described hereinbefore with reference to FIG. 4*a*, until the crusher is empty or nearly empty.

Emptying the crusher 1 in accordance with the embodiment illustrated in FIG. 4*b* may provide a safer emptying process than the emptying process in accordance with FIG. 4*a*. The reason is that with the embodiment illustrated in FIG. 4*b* the crushing from point b2 occurs at close to the lowest rpm at which any crushing occurs, such as 200 rpm. With such a low rpm, the crushing action could be stopped very quickly, by reducing the rpm to, for example, 50 rpm, if the amplitude α would suddenly increase, and any damage to the crusher would be quite limited at such a low rpm. With the embodiment of FIG. 4*a*, the crushing from point a2 would normally occur at a higher rpm, such as 300 rpm, which provides for a quicker emptying of the feeding hopper 50 and the crushing chamber 48, but also a larger risk of damage to the crusher 1 if the amplitude α would suddenly increase.

Figure 4C:
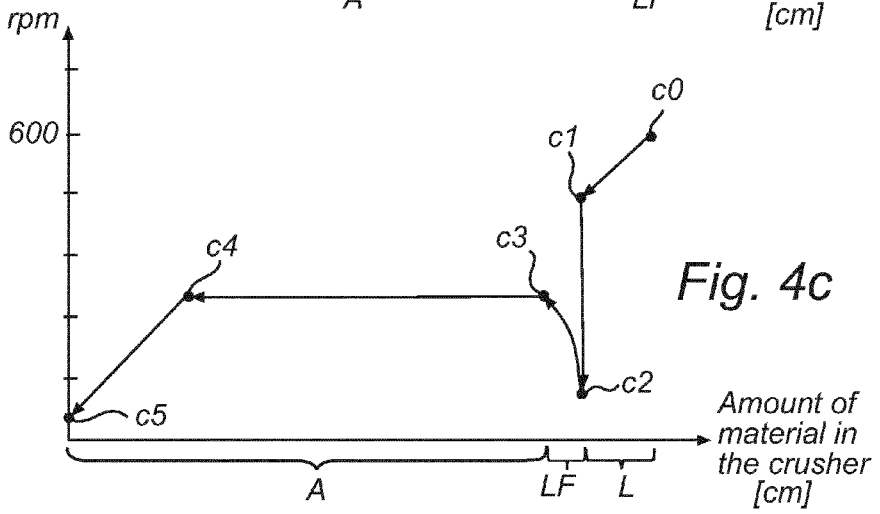

FIG. 4*c* is a graph illustrating a third embodiment of a method of emptying the crusher 1 of FIGS. 1-3 by controlling the rpm. In accordance with this third embodiment illustrated in FIG. 4*c* the crusher 1 may also be emptied by performing a combination of the steps shown in FIG. 4*a* and FIG. 4*b*. Such combination may give a faster emptying process than the process described in connection to FIG. 4*b* and a safer emptying process than the process described in connection to FIG. 4*a*.

The transport of material to the feeding hopper 50 is stopped, which is indicated by point c0 in the graph of FIG. 4*c*. The period between point c0 and point c1 in FIG. 4*c* is referred to as the level control period L, since the emptying process is controlled by the level of material in the hopper 50 as measured by means of the sensor 52 during this period. Hence, the rpm is decreased during the level control period L starting at point c0 and ending at point c1 in FIG. 4*c*, in the same manner as described regarding the level control period L in connection to FIG. 4*a*. At the point c1 in FIG. 4*c*, which occurs at a point when the sensor 52 is still reliable, the crusher 1 is abruptly stopped, in the same manner as occurs at point b0 in FIG. 4*b*. Thereafter the same process as is described in connection to FIG. 4*b* is carried out, i.e. the rpm is increased, during a low frequency period LF starting at point c2 and ending at point c3 in FIG. 4*c*, until substantial crushing again occurs, for example at an rpm of 200. The crusher 1 is then operated, during an amplitude control period A, typically at a constant rpm between points c3 and c4, and then, between the points c4 and c5, with gradually decreasing the rpm as determined by the control system 46 supervising the amplitude α of the crushing head 16 until the crusher 1 is emptied or nearly emptied, which occurs at point c5. Hence, with the embodiment of FIG. 4*c*, a level control period L is followed by a low frequency period LF and then an amplitude control period A. This enables quick emptying of the crusher with low risk of damage to the crusher.

Figure 5:
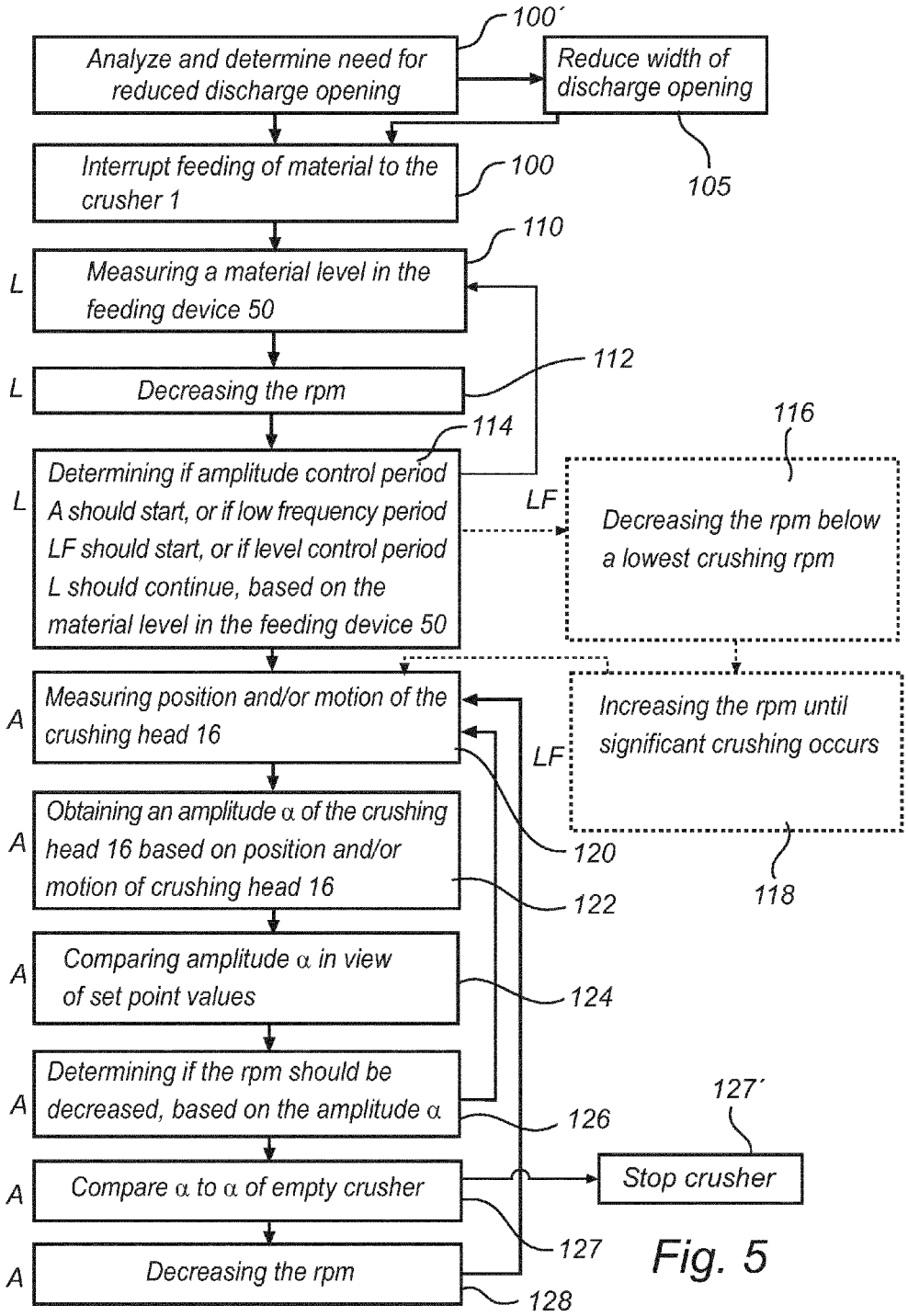
FIG. 5 is a flow chart illustrating a method of emptying the inertia cone crusher illustrated in FIGS. 1-3.

Referring to FIG. 5, a method for emptying the crusher 1 of FIGS. 1-3 will now be described in more detail. The method disclosed in FIG. 5 would typically refer to the embodiment illustrated in FIG. 4*a*, with the option of including also the low frequency period LF of the embodiment of FIG. 4*b* and hence arriving at something similar to the embodiment illustrated in FIG. 4*c*. Steps 100, 100' and 105 are the initiation of the emptying process. Steps 110, 112 and 114 are performed during the level control period L. Steps 116 and 118 are optional and are performed during the low frequency period LF. Steps 120, 122, 124, 126, 127, 127' and 128 are performed during the amplitude control period A.

In some cases it may be suitable to adjust the width of the discharge opening 51 of the crushing chamber 48 as part of the emptying sequence. If the discharge opening 51 is wide in view of the above described tilt a, for example 30-80 mm, it may be preferred to reduce the discharge opening 51, for example to half that width, to reduce the flow of material out of the crusher 1 and hence further improve the control of the emptying the crusher 1.

In step 100', the tilt angle is analysed and it is determined whether or not the discharge opening 51 should be reduced. If the discharge opening 51 should be reduced step 105 is initiated, otherwise the emptying method is moved on to step 100.

In step 105, the discharge opening is reduced.

In step 100, the feeding of material to the crusher 1 is interrupted. If a belt conveyor 53 is used, material to be crushed is no longer provided to the belt conveyor 53, and/or the belt conveyor 53 is stopped. Thus the level of material in the feeding hopper 50 will decrease.

In step 110, which commences immediately after step 100, the level of material in the feeding hopper 50 is measured by means of, for example, the sensor 52 located above the feeding hopper 50.

In step 112, the rpm is decreased, to avoid that the rpm becomes too high with respect to the amount of material that is present in the crushing chamber 48. As alternative to step 112 being initiated after step 110, steps 112 and 110 may begin at the same time, or step 112 may be initiated prior to step 110. According to one alternative embodiment, the level of material in the feeding hopper 50, measured in step 110, is used for controlling the rate of decreasing of the rpm in step 112.

In step 114, it is determined, based on the level of material in the feeding hopper 50 measured in step 110, whether the amplitude control period A should start, or if the low frequency period LF should start, or if the level control period L should continue. Typically, the measured level in the hopper 50 is compared to a level set point in step 114. If the measured level is higher than the level set point, the level control period L may continue. If the measured level is lower than the level set point, the low frequency period LF, or the amplitude control period A should start. If the level control period L is continued, step 110 is again started and the level of material is measured in the feeding hopper 50. If the optional low frequency period LF should start, step 116 is initiated. If the optional low frequency period LF is not to be used, step 116 and step 118 are omitted, and the amplitude control period A is immediately initiated, in step 120.

In step 116, the rpm of the crushing head 16 is abruptly decreased below a lowest rpm where no significant crushing occurs in the crushing chamber 48. Step 116 minimizes the danger of running the crusher 1 on an rpm which is too high in relation to the amount of crushing material present in the crushing chamber 48.

In step 118, the rpm is increased until significant crushing again occurs in the crushing chamber 48. Thus, the crusher 1 is run on a low rpm, which is high enough to have proper crushing but low enough for minimizing the risk of damaging the crusher 1 due to that too little material is present inside the crushing chamber 48.

After step 118, or immediately after step 114, as the case may be, the amplitude control period A is initiated in step 120. In step 120, at least one of a position and a motion of the crushing head 16 is measured, directly or indirectly. Irrespective of whether the steps 116 and 118 have been performed or not, the crusher 1 is controlled, during the amplitude control period A, on the basis of data from measurements of the amplitude α of the gyrating motion of the crushing head 16, as described above.

In step 122, an amplitude α of the crushing head 16 is obtained based on the position and/or motion measured in step 120.

In step 124, the position and/or motion measured in step 120, or the amplitude obtained in step 122, is compared to set point values. Thus, in step 124 the actual amplitude α as obtained in step 122 may be used, or the measured position and/or motion as measured in step 120 may be used, the position and/or motion being an indirect measurement of the amplitude α.

In step 126 it is determined, based on the comparison in step 124, whether the rpm should be changed, which would normally mean that the rpm is decreased, or if the rpm may be kept constant for yet a period of time. If the rpm should not be decreased the method starts over at step 120 by measuring a position and/or motion of the crushing head 16.

In step 128, the rpm is decreased and the method starts over at step 120 by measuring a position and/or motion of the crushing head 16. The sequence of the steps 120 to 128 may continue until the crusher 1 is emptied.

In step 127 it is checked if material 56 is still present in the crusher 1. This may be done by comparing the amplitude of the crusher, $\alpha_{real}$, with a predetermined normal amplitude value, $\alpha_{normal}$. If, for instance, $\alpha_{real} \geq 2 \cdot \alpha_{normal}$ of the crusher 1, the crusher 1 is empty and the crusher 1 is, in step 127', stopped.

It will be appreciated that numerous variants of the embodiments described above are possible within the scope of the appended claims. For example, the use of a gyration sensor reflection disc 27 has been described above. However, the motion or position of the crushing head 16 may be measured based on the detection of other parts of the crushing head 16, the crushing head shaft 24, or any device connected thereto. Other types of sensors may be used, such as accelerometers.

Above, flexible joints 34, 36 of the Rzeppa type have been described. However, the crushing head of an inertia cone crusher may be driven via other types of flexible joints, such as universal joints.

Hereinbefore, an inertia cone crusher 1 having an unbalance weight 30 attached to the unbalance bushing 26 has been described. In other inertia cone crusher designs, the unbalance weight may have another location than in the crusher 1 described in detail hereinbefore; for example, the unbalance weight may, with appropriate and corresponding modifications to other parts of the crusher, be located on e.g. the crushing head shaft 24 and/or the vertical transmission shaft 32, in which cases those shafts would be unbalance bushings or shafts in the meaning of that feature of the appended claims.

Above, it has been described how the distances and angles $D_a$, $D_b$, and a may be used as measures of an amplitude of the gyrating motion of the central axis S of the crushing head 16. As will be appreciated by a person skilled in the art, also other measures indicating the magnitude of the gyrating motion of the crushing head 16 may be used as an indication of an amplitude.

A gyrating motion in the meaning of this disclosure need not be circular, but may, depending on crusher design and load, be e.g. elliptic, oval, or follow any other type of deformed generatrix due to constraints imposed by e.g. the design of the shape of the crushing chamber 48.

The invention claimed is:

1. A method for at least partly emptying a crushing chamber formed between an inner crushing shell and an outer crushing shell of an inertia cone crusher, the inner crushing shell being supported on a crushing head, said crushing head being rotatably connected to an unbalance bushing which is rotated by a drive shaft, said unbalance bushing being provided with an unbalance weight for tilting the unbalance bushing, such that a central axis of the crushing head will gyrate about a gyration axis with a rpm, crushing material in the crushing chamber, the method comprising the steps of:

interrupting feeding of material to the crusher;

measuring, directly or indirectly, at least one of a position and a motion of the crushing head during an amplitude control period;

comparing the measured position and/or motion to at least one set point value;

determining, based on said comparing the measured position and/or motion to at least one set point value, whether said rpm should be adjusted; and adjusting, when determined necessary, said rpm.

2. A method according to claim 1, wherein adjusting the rpm is made by decreasing the rpm.

3. A method according to claim 1, further comprising the step of obtaining, based on said position and/or motion of the crushing head, an amplitude of said crushing head.

4. A method according to claim 1, further comprising the step of measuring, during a level control period, a level of material in a feeding device, said feeding device being operative for forwarding material to be crushed to said crushing chamber, said level control period preceding said amplitude control period.

5. A method according to claim 4, further comprising the step of controlling said rpm based on the measured level of material in the feeding device during said level control period.

6. A method according to claim 5, further comprising the step of determining, during said level control period, based on said measured level of material in the feeding device, whether said amplitude control period should start or if said level control period should continue.

7. A method according to claim 4, further comprising the steps of, during a low frequency period, decreasing said rpm to a non-crushing rpm where no significant crushing occurs in the crushing chamber;

increasing said rpm to a lowest crushing rpm where significant crushing in the crushing chamber again occurs; and crushing material in the crushing chamber.

8. A method according to claim 7, further comprising the step of determining, during said level control period, based on said level of material in the feeding device, whether said amplitude control period should start or if said low frequency period should start; or if said level control period should continue.

9. An inertia cone crusher comprising:

an outer crushing shell;

an inner crushing shell, said inner and outer shells forming between them a crushing chamber, the inner crushing shell being supported on a crushing head, said crushing head being rotatably connected to an unbalance bushing rotated by a drive shaft, said unbalance bushing being provided with an unbalance weight for tilting the unbalance bushing when it is rotated, such that a central axis of the crushing head will, when the unbalance bushing is rotated by the drive shaft and tilted by the unbalance weight, gyrate about a gyration axis with a rpm, the inner crushing shell thereby approaching the outer crushing shell for crushing material in the crushing chamber;

a sensor for sensing at least one of a position and a motion of the crushing head during an amplitude control period; and a controller configured to compare the at one of a position and a motion to at least one set point value and adjust the rpm when necessary for operating the crusher and for at least partly emptying the crushing chamber.

* * * * *